US009162122B2

(12) United States Patent
Cameron et al.

(10) Patent No.: US 9,162,122 B2
(45) Date of Patent: Oct. 20, 2015

(54) GOLF CLUB SHAFT ADAPTOR

(71) Applicant: Acushnet Company, Fairhaven, MA (US)

(72) Inventors: Don T. Cameron, Carlsbad, CA (US); Nicholas Clinton Wade, Vista, CA (US)

(73) Assignee: Acrushnet Company, Fairhaven, MA (US)

( * ) Notice: Subject to any disclaimer, the term of this patent is extended or adjusted under 35 U.S.C. 154(b) by 153 days.

(21) Appl. No.: 13/740,019

(22) Filed: Jan. 11, 2013

(65) Prior Publication Data

US 2013/0184097 A1 Jul. 18, 2013

Related U.S. Application Data

(60) Provisional application No. 61/586,703, filed on Jan. 13, 2012.

(51) Int. Cl.
*A63B 53/16* (2006.01)
*A63B 59/00* (2015.01)
*A63B 53/00* (2015.01)

(52) U.S. Cl.
CPC ..... *A63B 53/16* (2013.01); *A63B 59/0044* (2013.01); *A63B 53/007* (2013.01)

(58) Field of Classification Search
CPC ..... A63B 59/0044; A63B 53/007
See application file for complete search history.

(56) References Cited

U.S. PATENT DOCUMENTS

| | | | | | |
|---|---|---|---|---|---|
| 2,305,270 | A | | 12/1942 | Nilson | |
| 3,284,114 | A | * | 11/1966 | McCord, Jr. et al. | 403/370 |
| 3,578,360 | A | * | 5/1971 | Eliot | 285/55 |
| 4,062,552 | A | * | 12/1977 | Kitaguchi | 279/103 |
| 4,852,782 | A | * | 8/1989 | Wu et al. | 224/661 |
| 5,496,029 | A | * | 3/1996 | Heath et al. | 473/296 |
| 5,569,096 | A | * | 10/1996 | Lee | 473/248 |
| 5,947,837 | A | * | 9/1999 | Perry | 473/313 |
| 6,015,355 | A | * | 1/2000 | Angel | 473/314 |
| 6,110,055 | A | * | 8/2000 | Wilson | 473/239 |
| 6,663,499 | B2 | * | 12/2003 | Riseley | 473/294 |
| 6,776,724 | B1 | * | 8/2004 | Siemsglusz | 473/294 |
| 6,780,120 | B2 | | 8/2004 | Murray | |
| 6,896,626 | B2 | | 5/2005 | Drossos | |
| 7,018,302 | B2 | | 3/2006 | Jacoby | |
| 7,074,135 | B2 | * | 7/2006 | Moore | 473/296 |
| 7,422,526 | B2 | * | 9/2008 | Nemeckay | 473/296 |
| 7,704,159 | B1 | * | 4/2010 | McDonald | 473/296 |
| 7,850,540 | B2 | * | 12/2010 | Sander et al. | 473/307 |
| 8,419,564 | B1 | * | 4/2013 | Solheim et al. | 473/296 |
| 8,636,603 | B2 | * | 1/2014 | Rauchholz | 473/221 |
| 2003/0050131 | A1 | | 3/2003 | Grace | |
| 2003/0083144 | A1 | * | 5/2003 | Shin | 473/296 |

(Continued)

*Primary Examiner* — Stephen Blau

(74) *Attorney, Agent, or Firm* — Kristin D. Wheeler

(57) ABSTRACT

The present invention is directed to a shaft lengthening system for a golf club. The shaft lengthening system comprises three components: an upper shaft portion that is attached to a grip, a lower shaft portion or portions that are attached to a club head, and a collet clamp assembly that couples the upper and lower shaft components together. The shaft components slideably engage with each other. The collet clamp assembly may comprise a collet secured to one of the shaft components and a collet clamp that interacts with the collet. Preferably, the collet clamp is threaded over the collet to clamp a portion of the collet to the other of the shaft components thereby setting the position of the shaft components relative to each other, and thus setting the overall length of the golf club shaft.

12 Claims, 6 Drawing Sheets

(56) References Cited

U.S. PATENT DOCUMENTS

2003/0148819 A1 8/2003 Lindner
2004/0116201 A1* 6/2004 Staub ..... 473/300
2005/0143186 A1 6/2005 Blattner et al.
2010/0077955 A1* 4/2010 Lee ..... 116/284

* cited by examiner

GOLF CLUB SHAFT ADAPTOR

CROSS REFERENCE TO RELATED APPLICATIONS

This application is a Non-Provisional Application claiming priority to U.S. Provisional Application No. 61/586,703, filed Jan. 13, 2012, the entire disclosure of which is hereby incorporated herein by reference.

FIELD OF THE INVENTION

The invention relates to a golf club shaft adapter for adjusting the length of a golf club. More particularly, the invention is related to a shaft lengthening system that comprises a collet clamp assembly that secures first and second shafts relative to each other to achieve a desired overall shaft length to the golf club.

BACKGROUND OF THE INVENTION

The design of golf clubs and particularly that of putters is typically viewed as a pursuit of an aesthetically pleasing club that promotes a golfer's confidence in his or her stroke. As such, many putters have been designed irrespective of the mechanics inherent in the putting swing. Furthermore, many putters lack a design that accounts for an individual golfer's characteristics and characteristic playing style (i.e., stance, grip, etc.).

The lack of attention to technical details in many putter designs results in clubs that are not aimed or balanced properly. Such technical considerations, for example, include heel and toe weight distribution, location of the putter head's center of gravity or "sweet spot," putter length, shaft flexibility, grip, head weight and total club weight, loft, and lie. Because the USGA Rules of Golf permit significant latitude in the design of putters, i.e., the shaft, neck or socket of a putter may be fixed at any point in the head, many putter designs are possible. And, because significant deviation in the intended path of a putt can be experienced for even slightly off-center hits, careful attention to these design factors can result in a putter that is more likely to perform well in use. Moreover, an adjustable length putter design may permit the variation of one or more of the aforementioned design considerations to more closely suit the needs of a given user.

What follows is an excerpt from a publication of the United States Golf Association entitled "A Guide to the Rules on Clubs and Balls", and in particular an excerpt regarding the rules for the adjustability of clubs:

"Adjustability Appendix II, 1b states that:

Woods and irons shall not be designed to be adjustable except for weight. Putters may be designed to be adjustable for weight and some other forms of adjustability are also permitted. All methods of adjustment permitted by the Rules require that:

(i) the adjustment cannot be readily made;

(ii) all adjustable parts are firmly fixed and there is no reasonable likelihood of them working loose during a round; and (iii) all configurations of adjustment conform with the Rules.

The disqualification penalty for purposely changing the playing characteristics of a club during a stipulated round (Rule 4-2a) applies to all clubs including a putter.

(i) General

In order to preserve the integrity of Rule 4-2 (Playing Characteristics Changed), this rule clearly states that it must not be too easy for a player to make adjustments during the course of a stipulated round. This is interpreted to mean that adjustments must require the use of a special tool, such as an Allen key or a Phillips screwdriver. It must not be possible to make the adjustments during a round.

(II) Adjustability for Weight

All clubs may be designed to be adjustable for weight, provided the adjustment mechanism conforms to the conditions described previously and in Appendix II, 1b of the Rules. Examples of what would and would not be permitted are illustrated below. [see FIG. 1 b]

As already noted in Design of Clubs, Section 1a, with respect to adjustments for weight, the only exception to the conditions described in (i) above is the addition or removal of lead tape. This is a practice which pre-dates the introduction of the adjustability rules and is permitted on 'traditional' grounds. Of course, the addition or removal of lead tape during a round is not permitted (see Rule 4-2a and Decision 4-2/0.5 in "Decisions on the Rules of Golf").

(III) Other Kinds of Adjustability

Only putters may be designed to be adjustable in ways other than weight. For example, a putter may be designed to be adjustable for lie and length. Again, these adjustments must require the use of a special tool, not just the fingers or a coin, etc. If, as is often the case, a screw is used to fix the mechanism, the putter must, for all practicable purposes, be unusable without the screw being in place and tightly fixed.

When assessing the conformity of an adjustable putter, it is important to remember the third condition listed in Appendix II, 1b, and to ensure that the putter cannot be adjusted into a position which does not conform to the Rules. For example, a putter which is adjustable for lie must not be adjustable into a position where the shaft diverges from the vertical by less than ten degrees (see Appendix II, 1d and Design of Clubs, Section 1d), or any other position which would render the club non-conforming."

Various adjustable club constructions are known. For example, U.S. Pat. No. 2,305,270 to Nilson discloses a golf club with a hosel that has an extension on which the head is slideably and pivotally mounted. The extension is embedded in a shallow depression in the back of the head and runs substantially the entire length of the head. The head further includes lugs with inner serrated portions, and when a desired angle has been selected for the face, serrated portions on the extension are engaged with the lugs to lock the position.

U.S. Pat. No. 6,780,120 to Murray teaches an extendable shaft of two pieces. The upper shaft has a captured screw member (a bolt) that is screwed into an operative receipt (a nut) in the lower shaft. This invention allows the shaft to be extended but not adjusted.

U.S. Pat. No. 6,896,626 to Drossos also teaches an extendable shaft of two pieces. A male non-circular annular flange is mounted to one section of the shaft, a female non-circular annual flange relief is mounted to the other section of the shaft, and a locking means couple the two sections to form the shaft. This invention also allows the shaft to be extended but not adjusted.

In addition, U.S. Pat. No. 7,018,302 to Jacoby teaches an extension shaft having a protruding threaded end which engages with a threaded aperture in a coupling device.

U.S. Pat. No. 7,850,540 to Sander et al. teaches a golf club having a shaft, a collet, and a club head having an interior chamber configured to receive the collet. This invention does not teach an adjustable shaft or an extendible shaft.

U.S. Pat. Appl. No. 2003/0050131 to Grace teaches an extendable shaft of two pieces. The shaft extensions are of predetermined length and are not adjustable.

U.S. Pat. Appl. No. 2003/0148819 to Lindner teaches an elongated shaft having a housing into which is inserted a predetermined weight. This invention allows the shaft to be extended and weighted but not adjusted.

U.S. Pat. Appl. No. 2005/0143186 to Blattner et al. teaches a shaft extension that is attached by means of a reverse-thread connection. This invention allows the shaft to be extended but not adjusted.

Despite these developments, there exists a need for an improved golf club construction. In particular, there is a need for an improved golf club with adjustable shaft length.

SUMMARY OF THE INVENTION

The present invention is related to an adjustable length golf shaft for attachment to a club head. The adjustable length shaft comprises three components: a first shaft portion that is attached to the grip, a second shaft portion that is attached to a club head or to another shaft portion connected to the club head, and a collet clamp assembly that couples the two shaft components together. The adjustable shaft may be used on any golf club. The adjustable shaft is preferred for use on putters, and most preferred for use on putters with long shafts such as "belly" putters.

A golf club having an adjustable shaft length according to the present invention is provided comprising a first shaft portion, a second shaft portion, the shaft portions slideably engageable with each other, and a collet clamp assembly provided on one of the first or second shaft portions to secure the first and second shaft portions relative to each other. The collet clamp assembly further comprises a collet having at least a first portion attached to one of the first or second shaft portions. A collet clamp is provided that mates with the collet to clamp a second portion of the collet to the other of the first or second shaft portions to set a relative position between the first and second shaft portions to achieve a desired overall shaft length.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENTS

Figure 1:
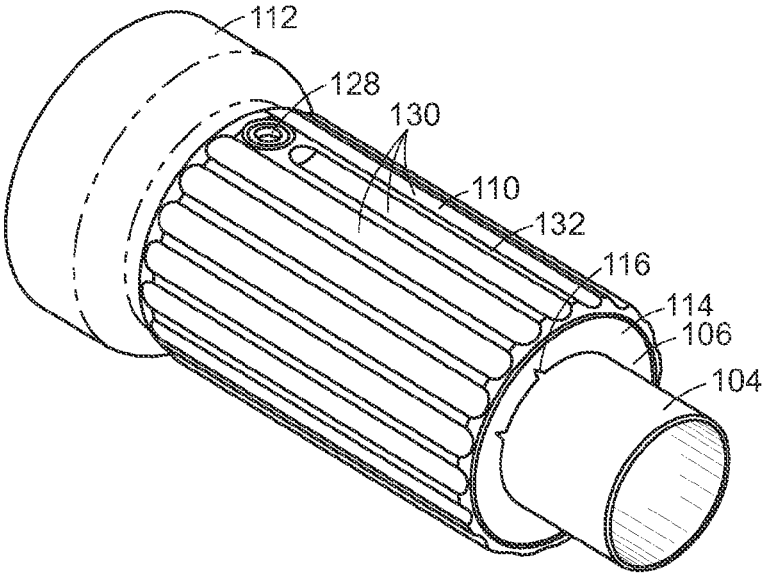
FIG. 1 is a perspective view of an embodiment of a shaft lengthening system according to the present invention.
Figure 2:
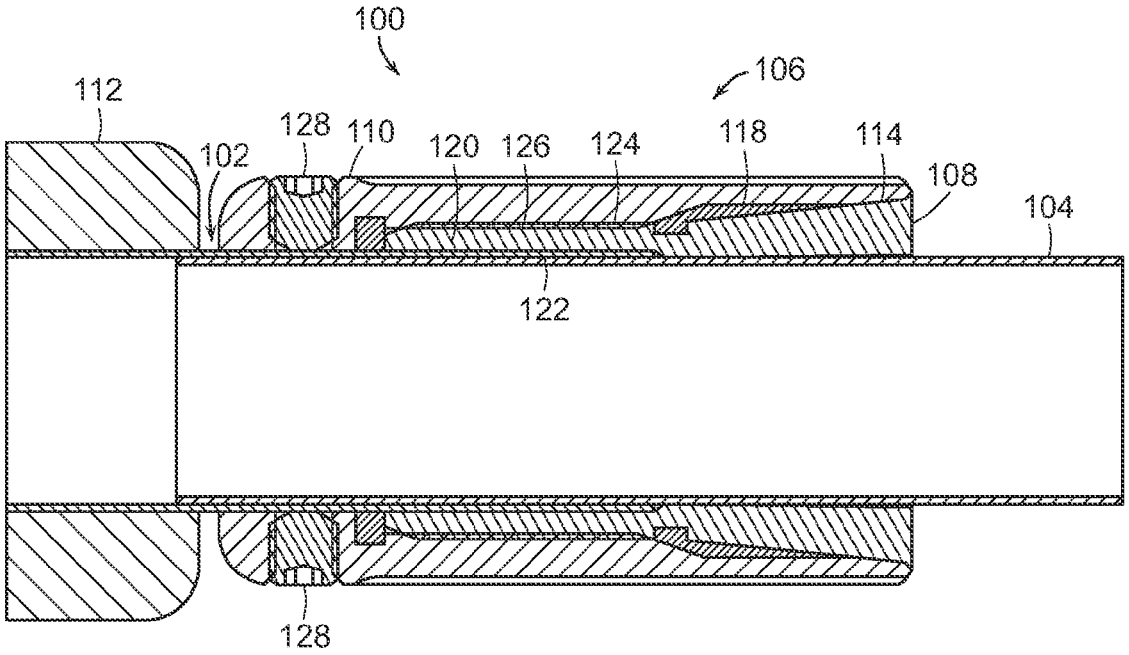
FIG. 2 is a cross-sectional view of the shaft lengthening system of FIG. 1.

Referring generally to FIGS. 1-2, a shaft lengthening system 100 according to the present invention is shown. In FIG. 2, a first shaft portion 102 is adjustably connected to a second slider shaft portion 104 by means of a collet clamp assembly 106. In one embodiment, the collet clamp assembly 106 includes a collet 108 and a collet clamp 110. One of the first or second shaft portions 102, 104 includes a grip 112. The collet 108 is attached to the first shaft portion 102 and the second shaft portion 104 is slideably engaged with the first shaft portion 102. In another embodiment, the collet clamp assembly 106 is attached to the second shaft portion 104 and the first shaft portion 102 is slideably with the second shaft portion 104. In yet another embodiment, two collet clamp assemblies 106 are attached to a third center shaft portion (not shown) and both first and second shaft portions 102, 104 are slideably engaged with the center shaft portion. The shaft portions 102, 104 may be metallic, non-metallic, composite or any other suitable material. The shaft portions 102, 104 are coaxial and slideable relative to each other so as to adjust the overall shaft length of the club. The present invention allows an adjustment in the length of the shaft that is greater than about 0.5 inch, preferably greater than about 1 inch, more preferably greater than about 3 inches, still more preferably greater than about 6 inches, and most preferably from about 1 inch to about 24 inches. It will be appreciated that the present invention allows for a continuous change in shaft length. Alternatively, the shaft may be adjusted in pre-determined increments.

The ability to adjust the shaft length of a golf club improves the control of the club and allows for customization of the club for the golfer. Standard length putters are generally commercially available with shaft lengths in the range of 32 to 36 inches. Belly putters are generally commercially available in lengths of 36 to 44 inches. Long putters are generally available in shaft lengths of 44 to 53 inches. However, since height, stance, and swing are all important factors in selecting the most effective putter length, adjustability confers a significant advantage. It will be appreciated that the collet clamp assembly 106 may be used on any club to adjust shaft length including drivers, fairways, hybrids and irons, not just putters.

Referring specifically to the first embodiment of FIGS. 1-2, the collet clamp assembly 106 includes the collet 108 and the collet clamp 110. The collet 108 features a tapered portion 114 having slits 116. The collet clamp 110 features an inner surface having a mating tapered surface 118. As shown in FIG. 1, the collet clamp assembly 106 includes the collet 108 having a portion 120 attached to the first shaft portion 102, or upper shaft, such that tapered portion is engageable with the second shaft portion 102. At least the portion 120 of the collet 108 may be attached to the shaft by an epoxy adhesive 122. In another embodiment the portion 120 of the collet 108 may be attached by double sided adhesive tape. In still another embodiment the portion 120 of the collet 108 may be attached by any other type of adhesive such as cyanoacrylate or silicone. In yet another embodiment the portion 120 of the collet 108 may be attached mechanically by, for example, the compressive friction created by tightening the collet clamp 110, or by mating threads cut in the inside surface of the collet 108 and the outside of the first shaft portion 102. Any sufficient means for holding the collet clamp assembly 106 in place with sufficient strength may be used. It will be appreciated that the collet 108, once attached, may be removable from the shaft. For example, if a player no longer wants to be able to adjust the length of the shaft of the club, the collet clamp assembly 106 may be removed.

As illustrated in FIG. 2 shows the collet clamp 110 has internal threads 124 to engage the corresponding external threads 126 on the collet 108. Tightening the collet clamp 110 onto the collet 108 with the threaded engagement causes the tapered surface 118 of the collet clamp 110 to contact the tapered portion 114 of the collet 108. The further the collet clamp 110 is tightened onto the collet 108 the more the slits 116 on the collet 108 are compressed by the increased contact between the tapered surface 118 with tapered portion 114, thereby clamping the tapered portion 114 of the collet 108 to the second shaft portion 104. Thus, the first, or upper, shaft portion 102 is secured to the second, or lower, shaft portion 104 at the desired location on the second shaft portion 104 to set the desired overall shaft length.

FIG. 1 shows a perspective view of the collet clamp assembly 106 including the collet clamp 110 having a plurality of flutes 130 on an outer surface 132 to allow additional surface area to grip for tightening the collet clamp 110 onto the collet 108 to secure the relative position of the second shaft 104 relative to the first shaft 102 before securing one or more set screws 128 to set the length of the club. The set screws 128 may then be engaged to fix the collet clamp assembly and thereby the relative positions of the first and second shafts 102, 104 at their desired relative position to give the putter the desired length for play. Thus, set screws 128 allow the collet clamp assembly 106 to be fixed in place for play. These set screws 128 may require a special tool (i.e. an allen key) to loosen the collet clamp 110 in order to make a length adjustment to the shaft. Thus, the present invention may conform to the USGA Rules of Golf.

Figure 3:
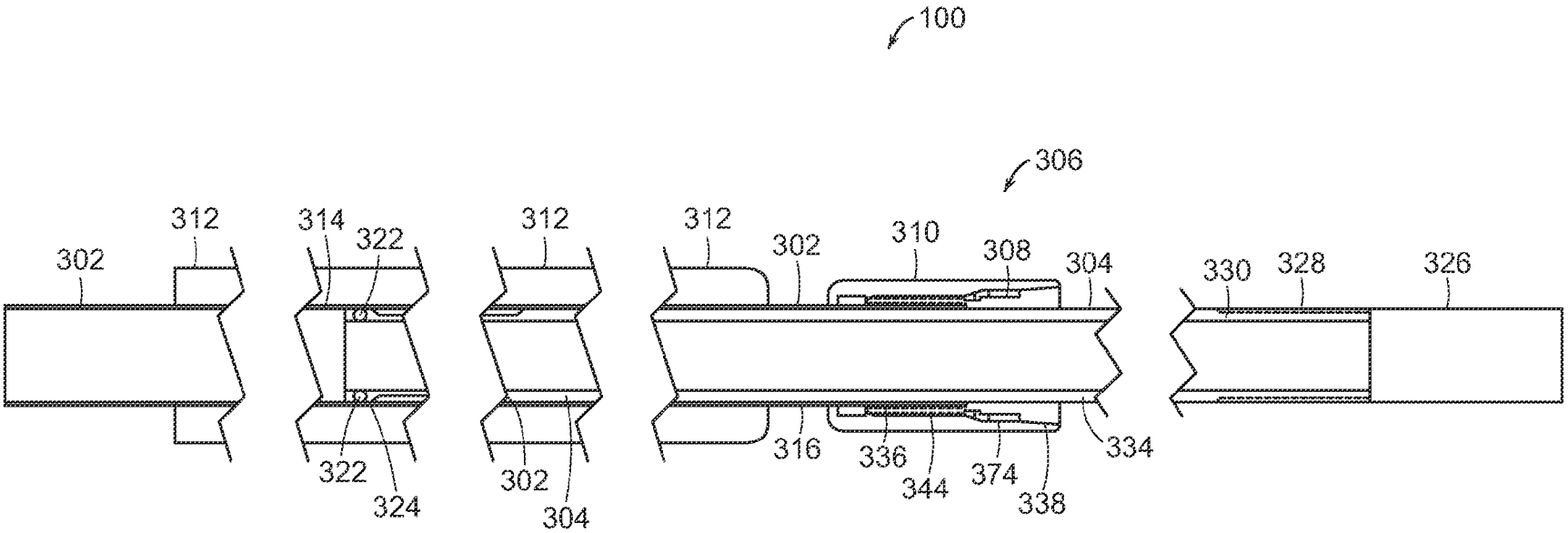
FIG. 3 is a cross-sectional view of another embodiment of the shaft lengthening system according to the present invention.
Figure 4:
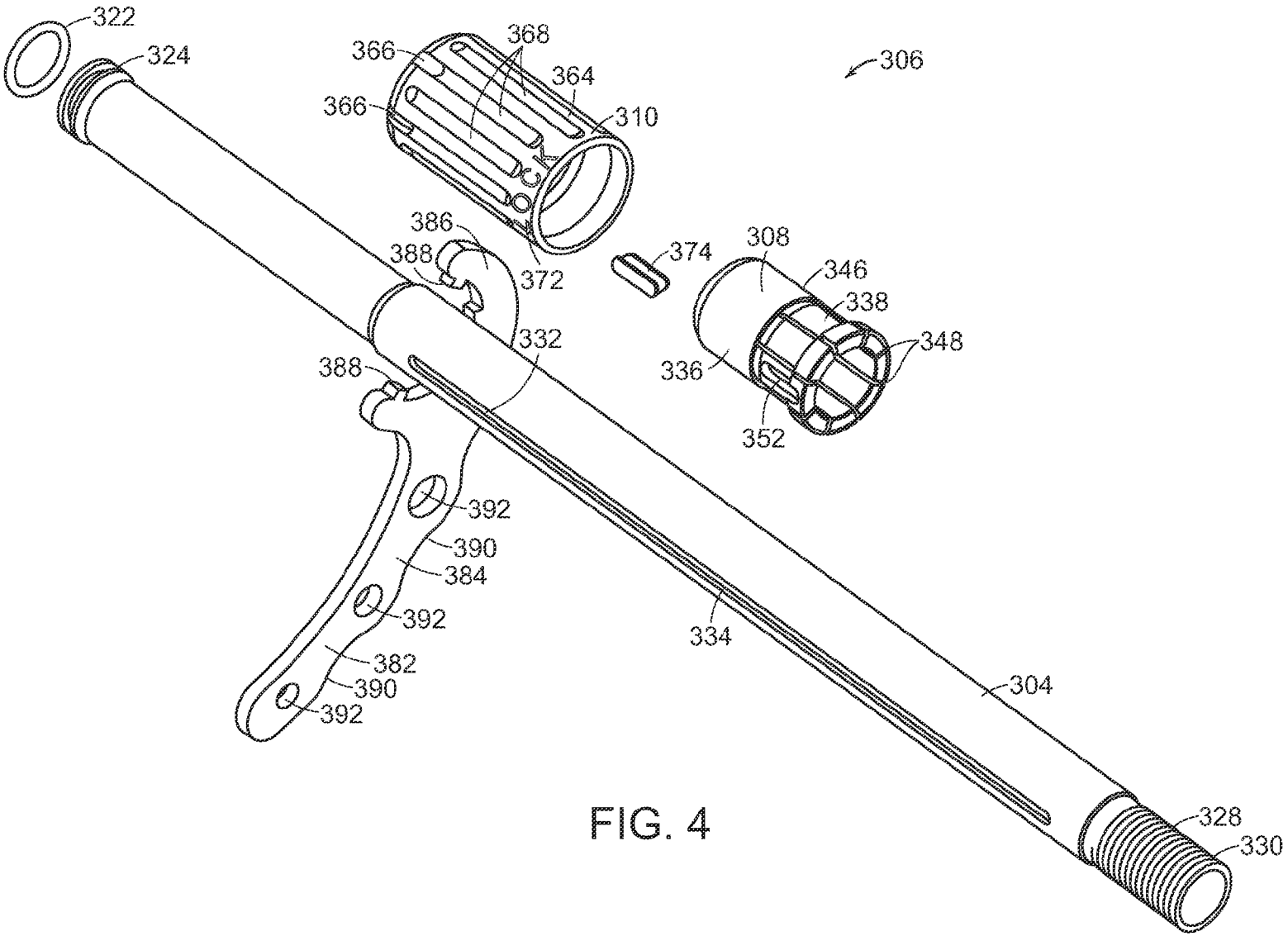
FIG. 4 is an exploded view of a collet clamp assembly of the shaft lengthening system of FIG. 3.

FIGS. 3 and 4 illustrate another preferred embodiment of the shaft lengthening system 100 of the present invention. As shown, the shaft lengthening system 100 features a first shaft portion 302, a second shaft portion 304 and a collet clamp assembly 306. The collet clamp assembly 306 includes a collet 308 and a collet clamp 310. The first shaft portion 302 includes a grip 312 secured to a part 314 of the first shaft portion 302, and a second part 316 of the first shaft portion 302 extends beyond the grip 312 to receive the collet 308. The grip 312 may be secured in any suitable manner as is known to those of skill in the art of golf clubs. It will be appreciated that the first shaft portion 302 may feature multiple grips (not shown). For example a second grip (not shown) may be placed above the grip 312 on the first shaft portion 302.

Second shaft portion, or slider shaft, 304 slides axially within the first shaft portion 302 such that the position of the second shaft portion 304 relative to the first shaft portion 302 may be set to lengthen or shorten the overall shaft length of the club. It will be appreciated that the length adjustment as shown is continuous. In a preferred embodiment, the second shaft portion 304 may have markings 318 (FIG. 5) on the exterior surface 320 of the second shaft portion 304 to indicate the overall length of the shaft based on how much of the second shaft portion 304 is slid within the first shaft portion 302. These markings 318 may indicate any desired amount of length and may include any type of markings including dashes, dots, numbers, letters or any other suitable marks to indicate the length of the club. These markings 318 may be made in any suitable manner, including by engraving, etching and/or painting.

As shown in FIGS. 3 and 4, the end of the second shaft portion 304 within the first shaft portion 302 may feature an o-ring 322 to dampen vibration between the first and second shaft portions 302, 304. It will be appreciated that the o-ring 322 may be any suitable o-ring or other mechanism and have any desired cross-section, so long as it assists in damping the vibration between the first and second shaft portions 302, 304. Preferably, the o-ring 322 is made of a non-metal material and has a durometer of about 40-60 Shore A, preferably about 50 Shore A. The second shaft portion 304 may feature a recess 324 to receive the o-ring 322.

Figure 5:
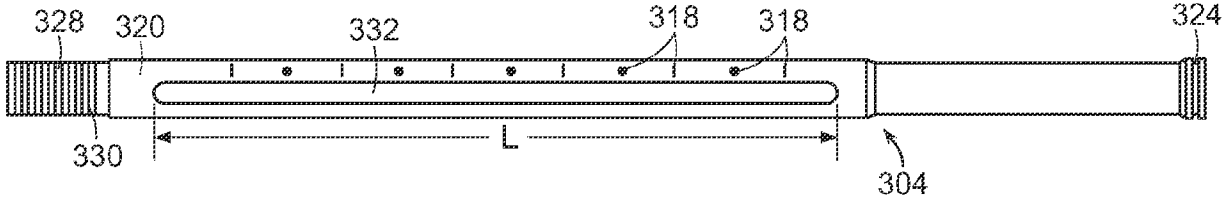
FIG. 5 is a front view of a second slider shaft of FIG. 4.

As shown in FIGS. 3-5, second shaft portion 304 is secured to a third shaft portion 326 which in turn is secured to a club head (not shown). The second shaft portion 304 may be bonded to the third shaft portion 326. As illustrated, the second shaft portion 304 may feature glue grooves 328 on an attachment portion 330 that receives the third shaft portion 326 to increase the surface area for bonding and thus improve the bond between them. Any suitable bonding agent may be used to secure the second and third shaft portions 304, 326. It will be appreciated that the second shaft portion 304 and third shaft portion 326 may be secured to each other in any suitable manner known to those of skill in the art of golf clubs. It will also be appreciated that the second shaft portion 304 may be secured directly to a club head (not shown), thereby not requiring the third shaft portion 326 to complete construction of the golf club.

Referring now to FIGS. 4 and 5, the second shaft portion 304 may feature a groove 332 extending through a wall 334 of the second shaft portion 304. The groove 332 may have any desired shape and length. This groove 332 extends along a section of the length of the second shaft portion 304 and will be described in further detail below. It will be appreciated that the groove 332 may or may not extend all the way through the wall 334 of the second shaft portion 304.

Figure 8:
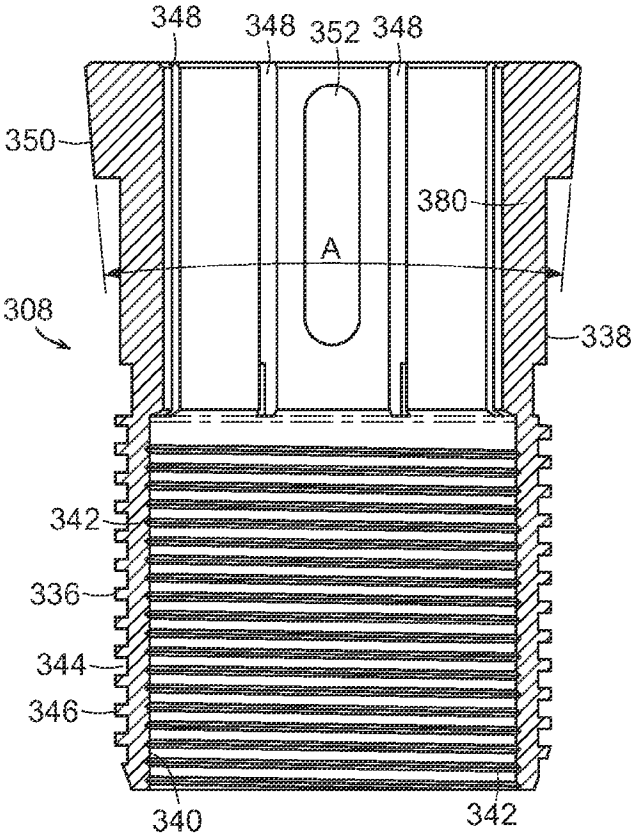
FIG. 8 is a cross-sectional view of the collet of FIG. 6.
Figure 7:
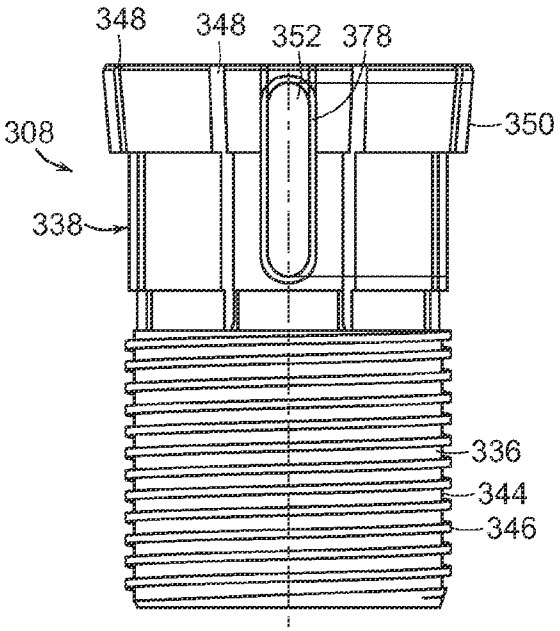
FIG. 7 is a front view of the collet of FIG. 6.
Figure 6:
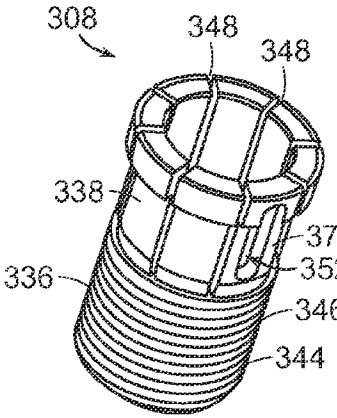
FIG. 6 is a perspective view of an embodiment of a collet of FIG. 4.

As described above, collet clamp assembly 306 features a collet 308 and a collet clamp 310. Referring now to FIGS. 6-8, the collet 308 includes a first collet portion 336 and a second collet portion 338. The collet 308 is hollow and is received over the first and second shaft portions 302, 304. The first collet portion 336 is secured to a second part 316 of the first shaft portion 302 that extends beyond the grip 312. As illustrated in FIG. 8 an inner surface 340 of the first collet portion 336 may feature glue grooves 342 to increase the surface area and thus the bond between the first collet portion 336 and the second part 316 of the first shaft portion 302. As described above, the first collet portion 336 may be secured to the second part 316 of the first shaft portion 302 in any suitable manner, including the use of epoxy or other any other adhesive or a mechanical lock, such as by the use of compression or a threaded engagement. Preferably, the second part 316 of the first shaft portion 302 does not extend beyond the first collet portion 336. The first collet portion 336 also features collet threads 344 on an exterior surface 346. These collet threads 344 may be any suitable type of threads. The collet threads 344 will be described in more detail below with regard to their interaction with the collet clamp 310.

The second collet portion 338 features a plurality of slits 348 that allow for the compression of the second collet portion 338 when engaged by the collet clamp 310. The second collet portion 338 also features a tapered exterior surface 350. Preferably the tapered exterior surface 350 has an angle A between about 5 and 15 degrees, more preferably angle A is about 10 degrees. Collet 308 may also feature a key opening 352 which extends through the wall of the second collet portion 338 and will be described in further detail below.

Figure 11:
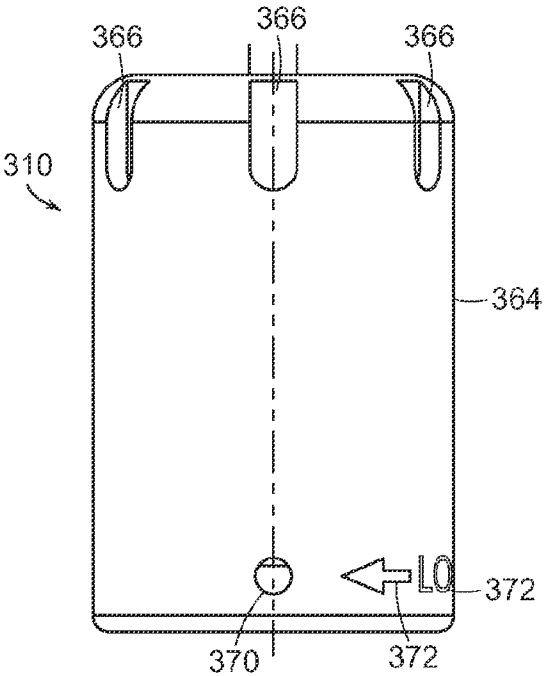
FIG. 11 is front view of the collet clamp of FIG. 9.
Figure 10:
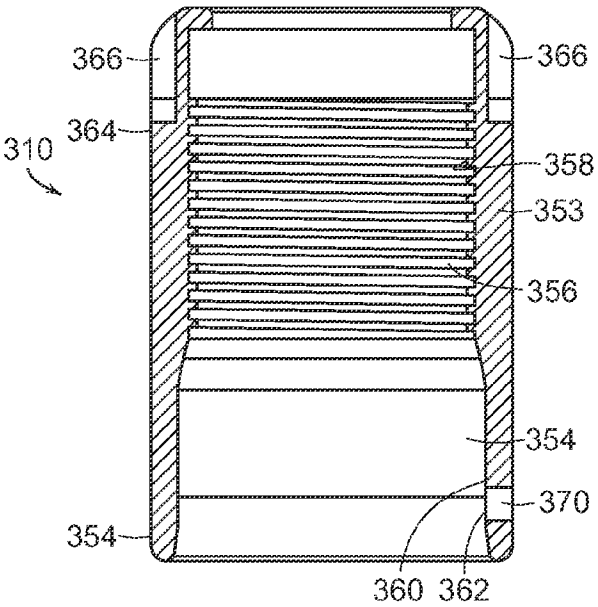
FIG. 10 is a cross-sectional view of the collet clamp of FIG. 9.
Figure 9:
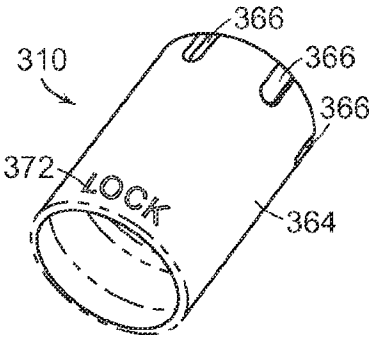
FIG. 9 is a perspective view of an embodiment of the collet clamp of FIG. 4.

Now referring to FIGS. 9-11, the collet clamp 310 is hollow and is adapted to be received over the first and second shaft portions 302, 304 and to be threadably engaged with the collet 308. The collet clamp 310 features a first collet clamp portion 353 and a second collet clamp portion 354. The first collet clamp portion 353 features clamp threads 356 on an interior surface 358 of the collet clamp 310. The clamp threads 356 are sized to mate with the collet threads 344 on the collet 308. The second collet clamp portion 354 features a tapered clamp surface 360 on an interior surface 362 of the collet clamp 310. The tapered clamp surface 360 is designed to mate and interact with the tapered exterior surface 350 on the collet 308. The collet clamp 310 has an exterior surface 364 with a plurality of notches 366. As shown in FIG. 4, the exterior surface 364 of the collet clamp 310 may also include flutes 368. The flutes 368 increase the surface area on the exterior surface 364 of the collet clamp 310 that make it easier to grip and tighten the collet clamp 310 onto the collet 308. Additionally, the exterior surface 364 may feature an indicator window 370 that will let the user know when the collet clamp 310 is locked in place. This feature will be discussed in more detail below. The exterior surface 364 of the collet clamp 310 may also include indicators 372 to let the user know in which direction to turn the collet clamp 310 in order to tighten the collet clamp 310 onto the collet 308 for securing the first and second shaft portions 302, 304 in position relative to each other. Such indicators 372 may include arrows and/or words such as "lock" or any other markings to instruct the user on using the collet clamp assembly 306.

Figure 13:
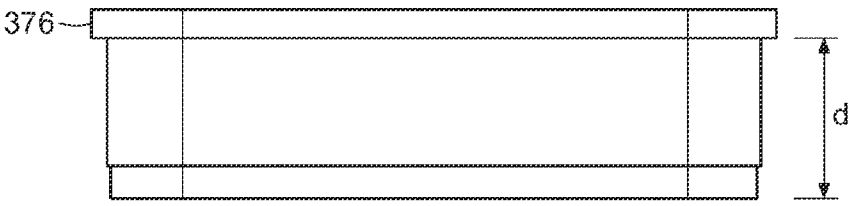
FIG. 13 is a front view of the key of FIG. 12.
Figure 12:
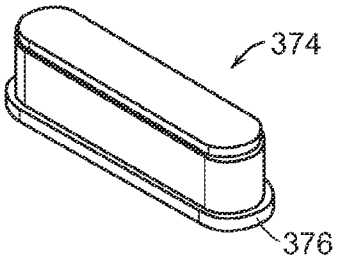
FIG. 12 is a perspective view of a key of FIG. 4.

A key 374 is shown in FIGS. 12 and 13. The key 374 as shown has an oblong shape and is sized and shaped to fit within the key opening 352 on the collet 308. The key 374 has a lip 376 that engages with a ledge 378 on the key opening 352 to keep the key 374 from sliding through the key opening 352. It will be appreciated that the depth d of the key 374 is greater than the thickness of the wall 380 of the collet 308. Thus the key 374 will extend through the wall 380 of the collet 308. The key 374 is sized to fit within the groove 332 of the second shaft portion 304 and by extending through the wall 380 of the collet 308 will also extend at least partially into the groove 332 of the second shaft portion 304. Thus, the key 374 may keep the second shaft portion 304 from rotating relative to the collet 308 and may also keep the second shaft portion 304 from sliding out of the first shaft portion 302. It will be appreciated that the key 374 may have any suitable shape to fit within the key opening 352 and groove 332. Additionally, it will be appreciated that the depth of the groove is equal to or greater than the depth d of the key 374 in order to accommodate the key 374. It will be appreciated that the length L of the groove 332, determines the amount of length adjustment allowed by the shaft lengthening system 100 and it will be understood that the groove 332 may have any desired length L to allow for the desired shaft length adjustment. Preferably, length L is greater than about 3 inches, more preferably greater than about 6 inches, more preferably between about 6 and about 24 inches and most preferably between about 7 and about 20 inches in length. Preferably, the overall shaft length is adjustable by greater than about 0.5 inches, preferably greater than about 1 inch, preferably greater than about 3 inches, more preferably greater than about 6 inches and most preferably from about 1 to about 24 inches in length.

Now referring again to FIGS. 3 and 4, after assembly the second shaft portion 304 slides within the first shaft portion 302 and the first collet portion 336 of the collet 308 is secured to the second part 316 of the first shaft portion 302 and the collet clamp 310 is provided over the first shaft portion 302 adjacent the grip 312 such that it may engage with the collet 308. During assembly, the key 374 is provided in the key opening 352 on the collet 308 and is also engaged with the groove 332 of the second shaft portion 304, such that the second shaft portion 304 will not rotate relative to the collet 308 or pull all the way out of the first shaft portion 302. The user may then adjust the amount of the second shaft portion 304 within the first shaft portion 302 to fix the relative positions of the first and second shaft portions 302, 304 to each other to achieve the desired overall club length. Once the first and second shaft portions 302, 304 are at their desired positions relative to each other, the collet clamp 310 is threaded onto the collet 308 thereby causing the clamp tapered surface 360 to engage with the tapered exterior surface 350 of the collet 308 and compress the slits 348 to clamp the second collet portion 338 to the second shaft portion 304 thereby fixing the overall club length.

Figure 14:
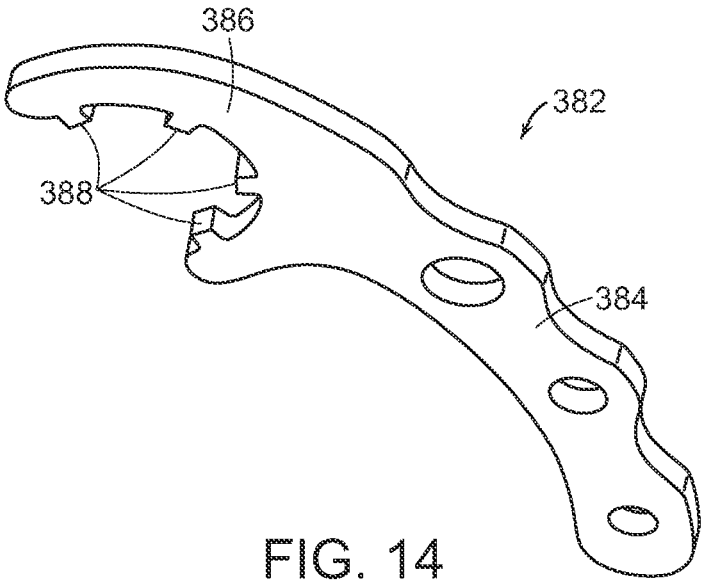
FIG. 14 is a perspective view of a wrench of FIG. 4.
Figure 15:
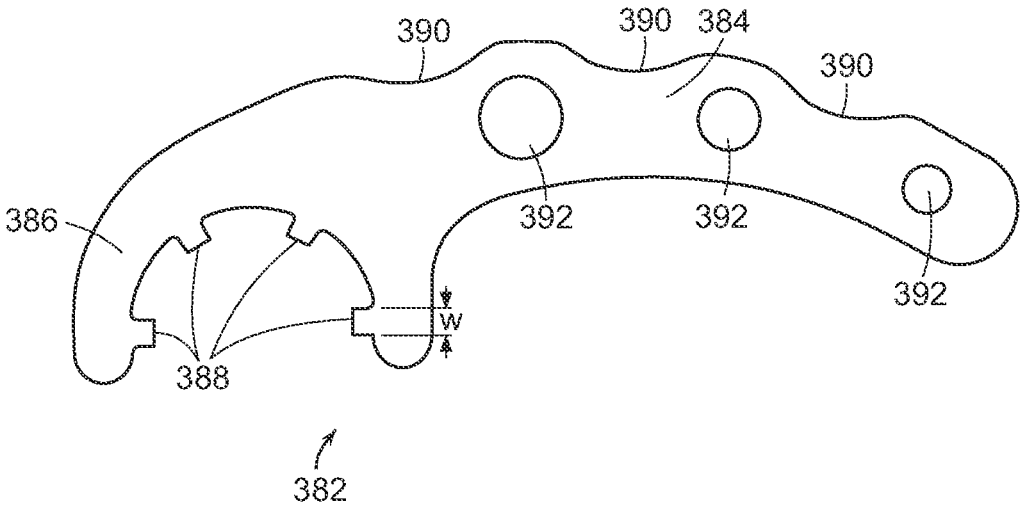
FIG. 15 is a front view of the wrench of FIG. 20.

It is foreseen that in one embodiment, this initial tightening may be done by hand and then locked using a special tool. However, it will be appreciated that a special tool may be used or needed to both tighten and lock and collet clamp 310 to the collet 308. As illustrated in FIGS. 4 and 14 and 15, the special tool may be a wrench 382. The wrench 382 features a handle portion 384 and a tool portion 386. As illustrated, the tool portion 386 has a C shape that mates at least partially with the exterior surface 364 of the collet clamp 310. The tool portion 386 features protrusions 388 that mate with the notches 366 on the collet clamp 310. There may be any desired number of protrusions 388. Preferably there are at least two protrusions, and most preferably there are four protrusions. The protrusions may have any desired width w that fits in the corresponding notches 366 on the collet clamp 310. The wrench 382 may also feature indents 390 on the handle portion 384 to accommodate the user's fingers for grasping the handle portion 384. Additionally, the handle portion 384 may feature one or more openings 392. When the protrusions 388 are engaged in the notches 366, the wrench 382 may be used to apply torque to the collet clamp 310 and tighten the collet clamp 310 to the collet 308. In a preferred embodiment, the collet clamp 310 features the window 370 and when the collet clamp 310 has been tightened to its locked position a red, or any other color, mark provided on the exterior surface 350 of the collet 308 may show through the window 370 of the collet clamp 310 indicating to the user that the system has been properly locked. The shaft lengthening system 100 may also include a noise indicator, such as a clicking noise, to allow the user to hear when the system is properly locked. The wrench 382 may be used to apply torque in the opposite direction to unlock the collet clamp 310 from the collet 308 to allow further modification to the overall length of the shaft of the golf club. It will be appreciated that the system 100 may be constructed such that the putter is not usable until the system is properly locked, in that the first and second shaft portions 302, 304 may slide relative to each other until the system 100 is locked.

In the preferred embodiment the golf club is a belly putter or a long putter. Although, as described above, it will be understood that the shaft lengthening system 100 may be used on any length putter to refine the shaft length to properly fit the golfer or to change the shaft length to alter the putter from a regular length putter to a long putter, vice versa, or any length in between, or between a belly and a long putter or vice versa. The present invention may also be useful in fitting women and junior golfers. The collet clamp assembly 106, 306 may be made of any suitable metal or non-metal material. Each part as described herein may be made of the same or a different material. Preferably the collet 108, 308 and collet clamp 110, 310 are made of aluminum. Although, it will be appreciated that they could be made of any suitable material including titanium, magnesium, stainless steel or any other suitable metal or non-metal material. The putter head (not shown) may comprise any type of suitable metal or non-metal material, including steel, stainless steel, brass, bronze, or composite. The putter may comprise blade or mallet type heads. Moreover, the putter head may comprise face inserts, offsets, perimeter weighting, or stabilizing members.

The first shaft portion 102, 302 and second shaft portion 104, 304 may be straight, non-tapered, sections. In another embodiment, the shafts 102, 104, 302, 304 are tapered and the collet 108, 308 is similarly tapered to match the taper of the shaft sections. In yet another embodiment, the first shaft portion 102, 302 or the second shaft portion 104, 304 may be tapered except for a portion that is straight and non-tapered for means of length adjustment as taught in the present invention. The shaft portions 102, 104, 302, 304 may be metallic, non-metallic, composite or any other suitable material.

The grip 112, 312 may comprise a standard hand grip, a grip with alignment indicia, a bulbous grip, a T-shaped grip, a curved T-shaped grip, or a grip having a circular or semicircular ring designed to rest on a forearm, bicep, or shoulder or any other suitable grip. The grip may be any means to hold, stabilize, or pivot the club during use. Typically, belly putters have a 21 inch grip. Long putters typically have two grip sections with at least one of the sections being 21 inches long. The present invention may include a single grip of about 22 to 27 inches for long putters. Preferably, the grip is about 23 and 26 inches long, most preferably the grip is about 25 inches long. It will be appreciated that this single grip could be used with the present invention to alter the shaft length between a belly and a long putter. It will be appreciated that multiple grip sections may also be used with this longer grip.

The embodiments of the present invention are illustrated with putter-type clubs. However, it should be understood that any type of golf club, including drivers, woods, irons and wedges, can utilize the inventive adjustable length shaft collet clamp assembly. Additionally, the collet clamp assembly 106, 306 can be used with non-golf equipment, such as fishing poles, aiming sights for firearms, plumbing, etc.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention and are to be included as further embodiments of the present invention. Elements from one embodiment can be incorporated into other embodiments. Therefore, it will be understood that the appended claims are intended to cover all such modifications and embodiments, which would come within the spirit and scope of the present invention.

We claim:

1. A golf club having an adjustable shaft length comprising:

a first shaft portion, a second shaft portion, the shaft portions slideably engageable with each other, and a collet clamp assembly provided on one of the first or second shaft portions to secure the first and second shaft portions relative to each other;

wherein the collet clamp assembly further comprises a collet having at least a first portion attached to one of the first or second shaft portions and a collet clamp that mates with the collet to clamp a second portion of the collet to the other of the first or second shaft portions to set a relative position between the first and second shaft portions to achieve a desired overall shaft length wherein the collet further comprises slits and the collet clamp is threadably engaged to the collet to compress the slits and secure a portion of the collet to the other of the first or second shaft portions;

and wherein the collet further comprises a key opening, the second shaft portion further comprises an elongated groove along its length, the collect clamp assembly further comprising a key provided extending through the key opening and at least partially through a portion of the groove, such that the second shaft portion is prevented form rotating relative to the collet.

2. The golf club of claim 1, wherein the collet clamp assembly further comprises at least one notch engageable with a protrusion on a tool to tighten and lock the position of the collet clamp on the collet.

3. The golf club of claim 2, wherein the collet clamp assembly further comprises at least one window to show an indicator when the collet clamp is locked onto the collet.

4. The golf club of claim 1, wherein the groove has a length L, wherein the length L is at least about 6 inches.

5. The golf club of claim 4, wherein the length L is between about 6 to about 25 inches.

6. The golf club of claim 1, wherein the overall shaft length is adjustable by at least about 0.5 inch.

7. The golf club of claim 6, wherein the overall shaft length is adjustable by at least about 6 inches.

8. The golf club of claim 7, wherein the overall shaft length is adjustable by about 1 to about 24 inches.

9. The golf club of claim 1, further comprising at least one grip connected to one of the first or second shaft portions, wherein the grip has a length between about 23 and 26 inches.

10. The golf club of claim 1, wherein the golf club is a putter.

11. The golf club of claim 10, wherein the putter is selected from the group consisting of a standard length putter, a long putter, a belly putter, or an arm putter.

12. The golf club of claim 11, wherein the overall shaft length of the putter is adjustable such that the putter is usable as a belly putter or a long putter.

* * * * *